US006807386B2

(12) United States Patent
Yasui et al.

(10) Patent No.: US 6,807,386 B2
(45) Date of Patent: Oct. 19, 2004

(54) FIXING DEVICE AND IMAGE FORMING APPARATUS

(75) Inventors: Motokazu Yasui, Kanagawa (JP); Hideo Furukawa, Kanagawa (JP); Masanao Ehara, Saitama (JP); Masaharu Furuya, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/465,611

(22) Filed: Jun. 20, 2003

(65) Prior Publication Data

US 2004/0042825 A1 Mar. 4, 2004

(30) Foreign Application Priority Data

Jun. 20, 2002 (JP) ..... 2002-180568
Sep. 20, 2002 (JP) ..... 2002-275689
Apr. 30, 2003 (JP) ..... 2003-125899

(51) Int. Cl.[7] ..... G03G 13/20

(52) U.S. Cl. ..... 399/69; 399/70; 399/320; 399/329; 219/216

(58) Field of Search ..... 399/320, 69, 70, 399/67, 328, 330, 331, 335, 329; 219/216

(56) References Cited

U.S. PATENT DOCUMENTS 3,697,722 A * 10/1972 Furuichi et al. ..... 399/68
4,054,380 A * 10/1977 Donohue et al. ..... 399/21
4,102,681 A * 7/1978 Draugelis et al. ..... 430/30
5,118,920 A * 6/1992 Tanabe et al. ..... 399/35
5,627,634 A * 5/1997 Koh ..... 399/69
5,681,494 A * 10/1997 Suzuki ..... 219/216
5,729,798 A 3/1998 Yasui et al.
5,745,247 A 4/1998 Yasui et al.
5,747,774 A * 5/1998 Suzuki et al. ..... 219/216
5,819,136 A 10/1998 Tomita et al.
5,832,354 A 11/1998 Kouno et al.
5,839,032 A 11/1998 Yasui et al.
5,915,147 A 6/1999 Kouno et al.
6,006,051 A 12/1999 Tomita et al.
6,112,047 A 8/2000 Kato et al.
6,134,400 A * 10/2000 Higashi ..... 399/70
6,134,418 A 10/2000 Kato et al.
6,178,299 B1 * 1/2001 Kim ..... 399/88
6,219,520 B1 4/2001 Ehara
6,263,185 B1 7/2001 Kato et al.
6,333,490 B1 * 12/2001 Higashi et al. ..... 219/216
6,389,255 B1 5/2002 Sawada et al.
6,567,643 B2 5/2003 Yasui et al.
6,654,572 B2 * 11/2003 Kataoka ..... 399/69
6,721,516 B2 * 4/2004 Aoki et al. ..... 399/55
2002/0044806 A1 * 4/2002 Hayashi ..... 399/327
2002/0085852 A1 * 7/2002 Kataoka ..... 399/69
2002/0098011 A1 * 7/2002 Tamiya et al. ..... 394/127
2003/0091360 A1 * 5/2003 Onodera et al. ..... 399/69
2003/0231893 A1 * 12/2003 Yoshikawa ..... 399/69
2004/0033084 A1 * 2/2004 Akizuki et al. ..... 399/69
2004/0086294 A1 * 5/2004 Kataoka ..... 399/69
2004/0105708 A1 * 6/2004 Imai et al. ..... 399/330

FOREIGN PATENT DOCUMENTS

JP 11-2982 1/1999
JP 2914986 7/1999
JP 2002-82570 3/2002

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

A fixing device includes a fixing belt, a first heater, a second heater, a supporting roller, and a counter roller. During activation of the fixing device, a maximum power is supplied to the first heater, and only the first heater heats the fixing belt. When a temperature on the fixing belt reaches a first reference temperature, the fixing belt is driven rotationally, the power supplied to the first heater is dropped, and power is supplied also to the second heater. When the temperature on the fixing belt reaches a target temperature and the temperature on the counter roller reaches a second reference temperature, fixing operation is allowed to start.

31 Claims, 2 Drawing Sheets

FIXING DEVICE AND IMAGE FORMING APPARATUS

BACKGROUND OF THE INVENTION

1) Field of the Invention

The present invention relates to a technology for fixing an image carried on a recording medium by being passed through a space between a fixing belt and a counter roller.

2) Description of the Related Art

It has been known in the conventional technology to mount a fixing device of such a type on an image forming apparatus, for example, a digital copier, a printer, a facsimile, and a multifunction machine provided with at least two functions of them (see Japanese Patent Application Laid-Open No. 11-2982. Preferably, the fixing device of this type, as well as fixing devices of other types, is configured to elevate a temperature on the fixing belt up to a value suitable for fixing an image in as short a warm-up time as possible. A longer warm-up time forces an operator to suffer a longer stand-by time. Various fixing devices with reduced warm-up times have been proposed in the conventional technology to solve such the problem, though there is a need for a further reduced time.

The conventional fixing device of this type, on the other hand, always supplies power at a constant ratio to the first heater for heating the fixing belt and the second heater for heating the counter member to operate them. The fixing device thus configured causes various problems. For example, this configuration causes a problem to extend the warm-up time for the fixing device.

SUMMARY OF THE INVENTION

It is an object of this invention to solve at least the problems in the conventional technology.

A fixing device according to one aspect of the present invention includes a fixing belt which is driven rotationally, a counter member disposed opposite to the fixing belt, a first heater which heats the fixing belt, and a second heater which heats the counter member. The fixing belt and the counter member define a nip therebetween, through which a recording medium carrying a toner image to be fixed thereon is passed such that the toner image is directed to contact a surface of the fixing belt, in the presence of heat and pressure applied to toner in the toner image during passage thereof to fix the toner image on the recording medium. A target temperature on the fixing belt during fixation and first and second reference temperatures are previously set, first and second reference temperatures being lower than the target temperature. A maximum allowable power is supplied to the first heater to heat the fixing belt when the temperature on the fixing belt is lower than the first reference temperature during activation of the fixing device. The fixing belt is driven rotationally, power supplied to the first heater is decreased, and power is also supplied to the second heater when the temperature on the fixing belt reaches the first reference temperature. Fixation is allowed to start at a point in time at which the temperature on the fixing belt reaches the target temperature and the temperature on the counter member reaches the second reference temperature.

A fixing device according to another aspect of this invention includes a driving roller, a plurality of belt supports including the driving roller, a first heater, an endless fixing belt wound around between the belt supports and heated by the first heater; and a second heater. The device also includes a counter member disposed opposite to one of the belt supports via the fixing belt and heated by the second heater; and a temperature detector which detects a surface temperature on the fixing belt. If the surface temperature on the fixing belt is lower than a predetermined temperature during activation of the device, a first power is supplied to the first heater. If the surface temperature on the fixing belt reaches the predetermined temperature, a second power is supplied to heat the second heater, at least the fixing belt is driven rotationally, and the power supplied to the first heater is dropped to an amount equal to an amount obtained by subtracting the second power from the first power.

A fixing device according to still another aspect of this invention includes at least two belt supports, and a fixing belt wound around between at least the two belt supports, a counter member disposed opposite to one of the belt supports via the fixing belt. The device also includes a first heater which heats the fixing belt, a second heater which heats the counter member, and a temperature detector which detects a temperature on the fixing belt. The fixing belt and the counter member define a nip therebetween, through which a recording medium is passed to fix an image on the recording medium. The device further includes a power controller which varies a ratio of power supplied to the second heater to power to the first heater based on the temperature detected by the temperature detector.

A fixing device according to still another aspect of this invention includes at least two belt supports, a fixing belt wound around between at least the two belt supports, and a counter member disposed opposite to one of the belt supports via the fixing belt. The device also includes a first heater which heats the fixing belt, and a second heater which heats the counter member. The fixing belt and the counter member define a nip therebetween, through which a recording medium is passed to fix an image on the recording medium. The device further includes a time detector which detects a time of supplying power to at least one of the first and the second heaters, and a power controller which varies a ratio of power supplied to the second heater to power to the first heater based on the time detected by the time detector.

An image forming apparatus according to still another aspect of this invention includes the fixing device according to the present invention.

The other objects, features and advantages of the present invention are specifically set forth in or will become apparent from the following detailed description of the invention when read in conjunction with the accompanying drawings.

DETAILED DESCRIPTION

Exemplary embodiments of the present invention will be explained below with reference to the drawings.

Figure 1:
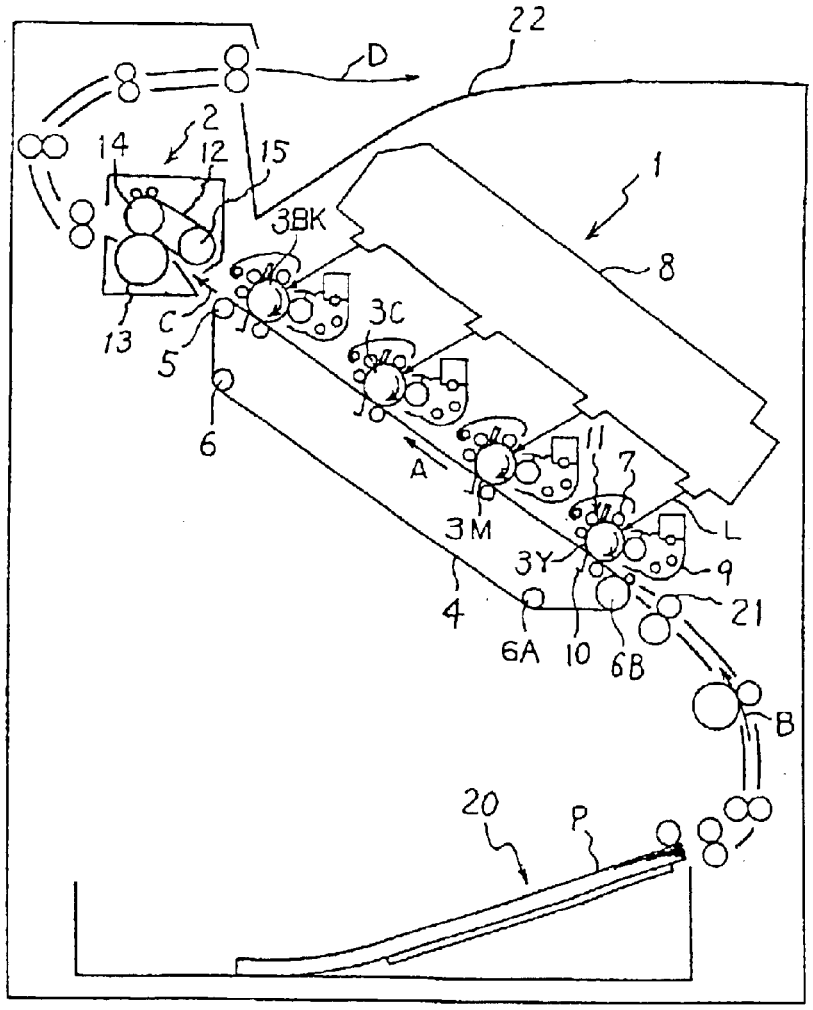
FIG. 1 is a schematic diagram of an image forming apparatus as one example.

FIG. 1 is a partial cross section of an image forming apparatus configured as a tandem full-color printer. The image forming apparatus includes an image forming unit 1 that forms a toner image on a recording medium, and a fixing device 2 that fixes the toner image on the recording medium so as to form a full color image on the recording medium. Such an image forming apparatus is configured as a digital copier, a printer, a facsimile, or a multifunction machine thereof. The image forming unit 1 is outlined first.

The image forming unit 1 includes first to fourth image carriers 3Y, 3M, 3C and 3BK configured as drum-like photoreceptors to form a yellow toner image, a magenta toner image, a cyan toner image, and a black toner image on the image carriers, respectively. As opposed to the first to fourth image carriers 3Y, 3M, 3C, 3BK, a transfer belt 4 is disposed. The transfer belt 4 is wound around among a driving roller 5 and driven rollers 6, 6A, 6B, and is driven rotationally in the direction of the arrow A.

As the first to fourth image carriers 3Y, 3M, 3C, 3BK have the substantially same configuration and operation to form a toner image thereon, only the configuration to form a toner image on the first image carrier 3Y is explained. The image carrier 3Y is rotationally driven in the clockwise direction in FIG. 1. The image carrier 3Y is charged to a certain polarity from a charging roller 7 as a charger. The charged surface is irradiated with an optically modulated laser beam L emitted from a laser writing unit 8. Thus, an electrostatic latent image is formed on the image carrier 3Y. The latent image is visualized as a yellow toner image at a developing device 9.

A paper feeder 20 is disposed at the lower side of the image forming apparatus to feed a recording medium P in the form of a sheet, such as a recording paper sheet, a resin sheet, and a resin film, in the direction of the arrow B. The recording medium P is sent to a space between the image carrier 3Y and the transfer belt 4 at certain timing adjusted by rotation of a pair of register rollers 21, and is carried on the transfer belt 4 and conveyed. A transfer device 10 is disposed at a position substantially opposite to the image carrier 3Y via the transfer belt 4. A voltage having an opposite polarity to the charged polarity of the toner on the image carrier 3Y is applied to the transfer device 10 to transfer the yellow toner image on the image carrier 3Y therefrom to the recording medium P. A cleaner 11 is employed to remove residual toner that is not transferred to the recording medium P and resided on the image carrier 3Y. The recording medium may also include a piece of ordinary paper, and an OHP sheet, as well as a card, a postcard, and an envelope.

Similarly, toner images of magenta, cyan, and black are formed on the second to fourth image carriers 3M, 3C and 3BK, respectively. These toner images are sequentially and superposedly transferred to the recording medium P to form a composite toner image on the recording medium P, to which the yellow toner image has been already transferred.

The recording medium P carrying the four-colored composite toner image before fixation is sent to the fixing device 2 in the direction of the arrow C. When the recording medium P passes through the fixing device 2, the toner image is fixed on the recording medium P to complete a full color image. The recording medium passed through the fixing device 2 is discharged as indicated with the arrow D to a paper discharge section 22 at the upper portion in the image forming apparatus.

Figure 2:
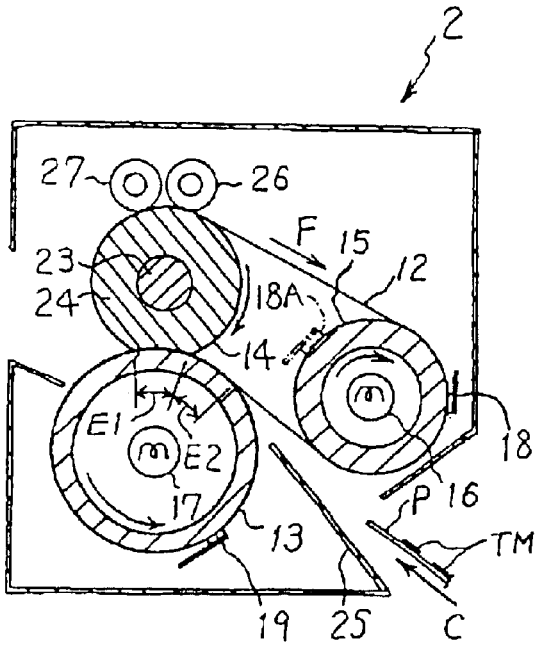
FIG. 2 is an enlarged cross section of a fixing device shown in FIG. 1.

FIG. 2 is an enlarged cross section of the fixing device 2. The fixing device 2 includes a fixing belt 12 formed of an endless belt wound around between at least two belt supports. In the shown example, the belt supports include a supporting roller 14 and a heating roller 15. The fixing belt 12 is wound around between the two rollers 14 and 15.

The fixing device 2 also includes a counter roller 13 as an example of the counter member disposed opposite to the fixing belt 12. The counter roller 13 press-contacts the fixing belt 12 to define a nip between the fixing belt 12 and the counter roller 13. In the fixing device 2 shown in FIG. 2, the counter roller 13 is arranged so as to have a portion E1 that press-contacts the supporting roller 14 via the fixing belt 12, and a portion E2 that press-contacts only the fixing belt 12. The counter member formed of the counter roller 13 is disposed opposite to the supporting roller 14 as one of the belt supports via the fixing belt 12.

The counter roller 13 may also be arranged such that the part of the counter roller press-contacting the fixing belt 12 entirely press-contacts the supporting roller 14 via the fixing belt 12, or that the part of the counter roller entirely press-contacts the fixing belt 12 only.

The heating roller 15 is driven so as to space from the supporting roller 14 to impart a suitable tension to the fixing belt 12 using a pressing unit formed of a spring and the like not shown. Thus, the heating roller 15 also serves as a tension roller that imparts a tension to the fixing belt 12. The supporting roller 14 includes a core metal 23 and an elastic layer 24 made of a heat-resistive porous material used to cover the core metal 23. The supporting roller 14 is driven so as to press-contact the counter roller 13 using a pressing unit formed of a resilient material such as a spring not shown.

The heating roller 15 and the counter roller 13 are hollowed. A first heater 16 for heating the fixing belt 12 and a second heater 17 for heating the counter roller 13 are provided in the rollers 15 and 13, respectively. These heaters 16 and 17 include halogen heaters, for example.

A first temperature detector 18 for detecting a temperature on the fixing belt 12, and a second temperature detector 19 for detecting a temperature on the counter roller 13 are provided. The temperature detectors 18 and 19 respectively detect temperatures on the fixing belt 12 and the counter roller 13 at portions that come in contact with the recording medium. In the shown example, the temperature detectors 18 and 19 include thermistors that respectively contact the surfaces of the fixing belt 12 and the counter roller 13.

Instead of the first temperature detector configured to detect the surface temperature on the fixing belt 12, it may be configured to detect the surface temperature on the heating roller 15, and detect the surface temperature on the fixing belt 12 based on the detected result. The surface temperature on the fixing belt 12 has a certain correlation with the surface temperature on the heating roller 15. Therefore, even such the temperature detector can detect the surface temperature on the fixing belt 12. For example, as indicated by a chain line in FIG. 2, such a first temperature detector 18A formed of a thermistor in contact with the surface of the heating roller 15 is used to detect the temperature on the surface of the heating roller 15. In this case, the surface temperature on the fixing belt 12 is determined as the temperature detected by the detector 18A minus a certain temperature.

Alternatively, the temperature detected by the first temperature detector 18A may be regarded as the surface temperature on the fixing belt 12. Thus, the temperature detector for detecting the temperature on the fixing belt can be configured to detect the surface temperature on the fixing belt 12 directly or indirectly.

In operation of fixation, the supporting roller 14, the heating roller 15, and the counter roller 13 rotate respectively in the directions of the arrows shown in FIG. 2 to drive the fixing belt 12 to rotate in the direction of the arrow F. One of the belt supports (the supporting roller 14 and the heating roller 15 in this example), which are employed to suspend the fixing belt 12 around them, is configured as a driving roller for driving the fixing belt 12. Such an endless fixing belt is wound around between the belt supports including the driving roller, and is driven to rotate.

At this time, the heat radiated from the first heater 16 is employed to heat the heating roller 15, which in turn heats the fixing belt 12. The heat radiated from the second heater 17 is employed to heat the counter roller 13 from the interior thereof. The first temperature detector 18 and the second temperature detector 19 detect the surface temperatures on the fixing belt 12 and the counter roller 13, respectively. Finally, based on the detected results, current flows into the heaters 16 and 17 are controlled to optimize these surface temperatures for fixing a toner image.

As shown in FIG. 2, the recording medium P carrying the composite toner image TM before fixation is sent to the fixing device 2 as indicated by the arrow C, as explained above with reference to FIG. 1. When the recording medium P passes through the nip between the fixing belt 12, which is driven rotationally and heated as explained above, and the counter roller 13, the toner image TM carried on the recording medium P is allowed to contact the fixing belt 12. In this case, toner is fused in the presence of heat and pressure applied thereto to fix the toner image on the recording medium P. The recording medium P having passed through the nip is further conveyed and then discharged to the paper discharge section. Thus, the recording medium P is passed through the nip between the fixing belt 12 and the counter member formed of the counter roller 13 to fix the image on the recording medium P.

In FIG. 2, the reference numeral 25 denotes a guide for guiding the recording medium P to the nip, 26 an application roller for applying an anti-offset oil on the surface of the fixing belt 12, and 27 a cleaning roller for cleaning the surface of the fixing belt 12.

As described above, the fixing device 2 in the embodiment includes the fixing belt 12 which is driven rotationally, the counter member formed of the counter roller 13 disposed opposite to the fixing belt 12, the first heater 16 which heats the fixing belt 12, the second heater 17 which heats the counter member, the first temperature detector 18 (or 18A) which detects the temperature on the fixing belt 12, and the second temperature detector 19 which detects the temperature on the counter member. The recording medium P carrying the toner image TM to be fixed thereon is passed through the nip between the fixing belt and the counter member. This recording medium P is passed through the nip such that the toner image TM is directed to contact the surface of the fixing belt 12 in the presence of heat and pressure applied to toner in the toner image TM during passage thereof to fix the toner image TM on the recording medium P.

The first heater 16 heats the fixing belt 12. The second heater 17 is additionally employed to heat the counter roller 13 for certain reasons, one of which is explained below.

When the composite toner image formed by superimposing multi-colored toner images on the recording medium is fixed, a large amount of fluctuation in the temperature for heating the composite toner image causes variations in luster of the fixed image to deteriorate the image quality thereof. Then, the second heater 17 is employed to heat the counter roller 13 to impart heat to the recording medium P passing through the nip, from the rear side opposite to the surface carrying the toner image TM to be fixed. This is effective to suppress the fluctuations in the temperature for heating the toner image. When the monochromic toner image carried on the recording medium is fixed, even if the temperature for heating the toner image may slightly fluctuate, the fixed image quality is not deteriorated greatly and accordingly, the second heater 17 is not required to heat the counter roller 13. To the contrary, the second heater 17 is required to heat the counter roller 13 when a multi-colored composite toner image is fixed.

As a large length in the conveyance direction of the recording medium can be designed at the nip between the fixing belt 12 and the counter roller 13, the fixing device 2 is suitable for fixing a color composite toner image formed of a large amount of toner carried on the recording medium. The fixing belt 12 can be designed to have a relatively small thermal capacity. Therefore, it is possible during activation of the fixing device to shorten the time required for elevating the temperature to the target temperature suitable for the fixing belt 12 to fix the toner image.

However, the counter roller 13 has a relatively large thermal capacity. Therefore, it takes a longer time during activation of the fixing device to elevate the temperature on the counter roller 13 to a certain temperature suitable for fixing the toner image. This results in a longer warm-up time for completing the activation of the fixing device. To solve such a problem, the fixing device 2 in the embodiment has the following configuration.

Figure 3:
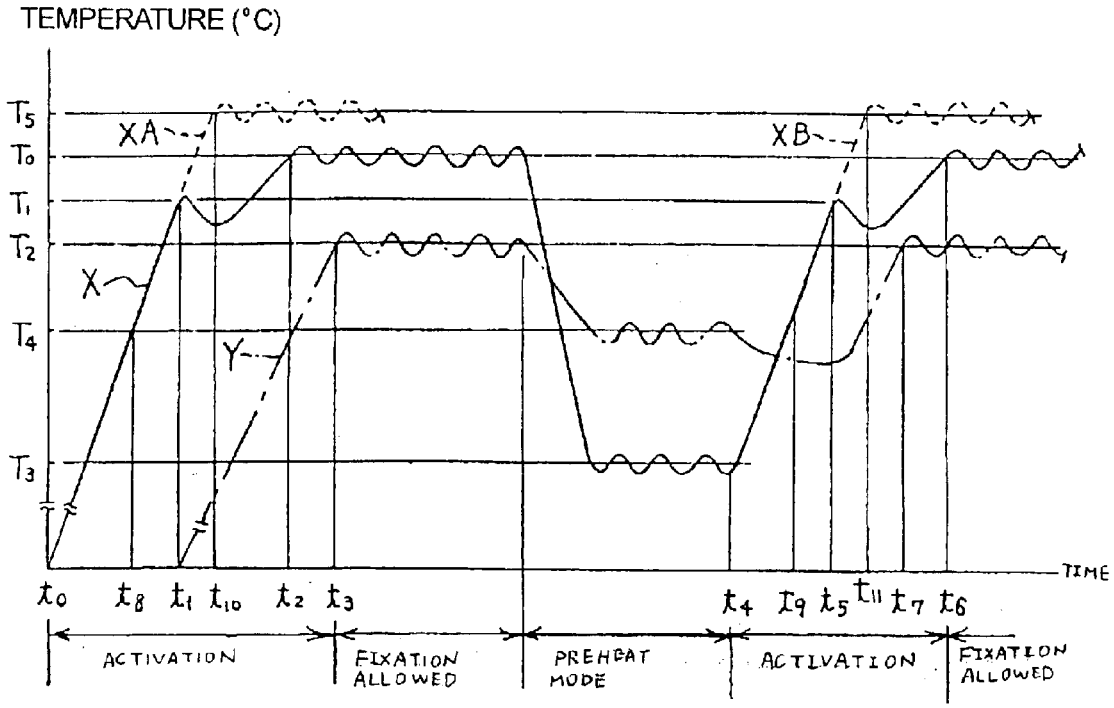
FIG. 3 illustrates variations in temperatures on a fixing belt and a counter roller.

FIG. 3 illustrates variations in the temperatures on the fixing belt 12 and the counter roller 13 after power to the image forming apparatus is turned on at $t_0$. In FIG. 3, the solid line X indicates the temperature on the fixing belt 12 detected by the first temperature detector 18, and the chain line Y indicates the temperature on the counter roller 13 detected by the second temperature detector 19. A target temperature $T_0$ on the fixing belt 12 during fixation is previously set, and first and second reference temperatures $T_1$ and $T_2$ lower than the target temperature $T_0$ are also previously set. The target temperature $T_0$ is a temperature on the fixing belt 12 suitable for fixing the toner image TM carried on the recording medium P. The target temperature $T_0$ is set to 170° C., for example. The second reference temperature $T_2$ is an appropriate temperature on the counter roller 13 for fixing the toner image TM. The temperature $T_2$ is set to 150° C., for example. The first reference temperature $T_1$ is set to 160° C., for example.

During activation of the fixing device 2 after the power-on of the image forming apparatus, if the temperature X on the fixing belt 12 detected by the first temperature detector 18 is lower than the first reference temperature $T_1$, a maximum allowable power is supplied to the first heater 16 to heat the heating roller 15 and the fixing belt 12 to elevate the temperature on the fixing belt 12. The maximum power supplied to the image forming apparatus is preset. The maximum power supplied to the fixing device 2 is also preset. For safe management, although the maximum power supplied to the first heater 16 is also preset, the maximum power (for example, 700 watts) is supplied to the first heater 16. At this moment, the counter roller 13, the supporting roller 14, the heating roller 15, and the fixing belt 12 are all halted, and power is not supplied to the second heater 17. The first temperature detector 18 is disposed so as to detect the temperature on the fixing belt 12 at a portion heated by the first heater 16 when the fixing belt 12 halts. In the fixing device 2 of the embodiment, the thermistor serving as the first temperature detector 18 contacts the surface of the fixing belt 12 at a portion in contact with the heating roller 15.

When the first temperature detector 18 detects that the temperature on the fixing belt 12 reaches the first reference temperature $T_1$ at the point of time $t_1$, at least the fixing belt 12 is driven rotationally. When the temperature on the fixing belt 12 at the portion heated by the first heater 16 reaches the first reference temperature $T_1$ while the fixing belt 12 halts, the fixing belt 12 is controlled to start rotating. In the shown example, when the temperature on the fixing belt 12 reaches the first reference temperature $T_1$, the counter roller 13, the supporting roller 14, and the heating roller 15 are all driven rotationally in the directions of the arrows in FIG. 2 to rotate the fixing belt 12 in the direction of the arrow F. At the same time, the power supplied to the first heater 16 is dropped to 400 watts from the previous value of 700 watts, for example. In addition, power is supplied to the second heater 17 to heat the counter roller 13 from the interior thereof. At this moment, the fixing belt 12 already rotates and accordingly the heat radiated from the fixing belt 12 also warms up the counter roller 13 from the outer surface thereof.

The fixing belt 12 and the counter roller 13 are heated together as explained above to elevate the temperatures thereon. The fixation is allowed to start at the time when the first detector 18 detects that the temperature on the fixing belt 12 reaches the target temperature $T_0$ at the point of time $t_2$ and the second detector 19 detects that the temperature on the counter roller 13 reaches the second reference temperature $T_2$ at the point of time $t_3$. That is, the fixation is allowed to start at the time when the temperature on the fixing belt 12 reaches the target temperature $T_0$ and the temperature on the counter roller 13 reaches the second reference temperature $T_2$. In this example, the fixation is allowed to start at the point of time $t_3$. The current flows into the heaters 16 and 17 are switched on and off so as to increase the temperature on the fixing belt 12 to the target temperature $T_0$ at the point of time $t_2$ and afterward and to increase the temperature on the counter roller 13 to the second reference temperature $T_2$ at the point of time $t_3$ and afterward. This is effective to reliably fix the toner image on the recording medium P.

As explained above, during activation of the fixing device 2, the fixing belt with a relatively small thermal capacity is first heated earlier by the first heater 16 using full power. Then, the counter roller 13 is heated from the interior thereof by the second heater 17 and is also warmed from the surface thereof by the heat from the fixing belt 12. Heating of the counter roller 13 from the interior as well as from the exterior can heat the counter roller 13 up to the second reference temperature in a short time. Accordingly, it is possible to shorten the warm-up time required for completing the activation of the fixing device 2 after the power-on of the image forming apparatus.

In the image forming apparatus shown in FIGS. 1 to 3, if no image is formed for a certain period of time after the power to the image forming apparatus is turned on, the fixing device 2 is shifted to a preheat mode. In this mode, the current flows to the first and the second heaters 16 and 17 are controlled in such a manner that the fixing belt 12 and the counter roller 13 reach to stand-by temperatures $T_3$ and $T_4$ that are lower than the target temperature $T_0$ and the reference temperature $T_2$. This is effective to reduce power consumption in the image forming apparatus.

Assume that a print command for instructing formation of a full color image on the recording medium is input at the point of time $t_4$ in such a situation as explained above. The first and second heaters 16 and 17 are controlled this time in the completely same manner as that during the activation of the device explained above. That is, when the temperature on the fixing belt 12 is lower than the first reference temperature $T_1$, a maximum allowable power is supplied to the first heater 16 to heat the fixing belt 12. When the temperature on the fixing belt 12 reaches the first reference temperature $T_1$ at the point of time $t_5$, at least the fixing belt 12 is driven rotationally, the power supplied to the first heater 16 is dropped, and power is supplied to the second heater 17. The fixation is allowed to start at the time when the temperature on the fixing belt 12 reaches the target temperature $T_0$ at the point of time $t_6$, and the temperature on the counter roller 13 reaches the second reference temperature $T_2$ at the point of time $t_7$. In this example, the fixation is allowed to start at the point of time $t_6$.

The image forming apparatus shown in FIG. 1 can form a full color image on the recording medium as described earlier. A mode at this time is referred to as a multi-color mode. In addition to the multi-color mode, the image forming apparatus shown in FIG. 1 can also select a monochromic mode for forming a monochromic image on the recording medium. For example, a black toner image is formed on the fourth image carrier 3BK shown in FIG. 1. The black toner image only is transferred onto the recording medium P and then fixed at the fixing device 2 to form a black monochromic image. When the fixing device 2 is activated in order to fix the monochromic toner image carried on the recording medium P, the power supply to the first and the second heaters 16 and 17 may also be controlled to heat the fixing belt 12 and the counter roller 13, respectively. When the monochromic toner image is fixed, the quality of the toner image is not deteriorated greatly, even if the temperature on the counter roller 13 does not reach the certain temperature $T_2$. From such a viewpoint, the fixing device 2 in the embodiment has the following configuration.

The target temperature $T_0$ is a target temperature on the fixing belt 12 required at the time of fixing a composite toner image composed of two or more (four in the shown example) color toner images superimposed and carried on the recording medium P. To the contrary, in the monochromic mode, the target temperature on the fixing belt 12 at the time of fixing a monochromic toner image carried on the recording medium is defined as a monochromic target temperature $T_5$. This monochromic target temperature $T_5$ may be higher than, lower than, or equal to the target temperature $T_0$. For example, the conveyance speed of the recording medium in the monochromic mode may be designed higher than that in the multi-color mode to increase the image formation speed. In this case, it is required to set the monochromic target temperature $T_5$ in the monochromic mode higher than the target temperature $T_0$ in the multi-color mode so as to prevent the amount of heat imparted to the toner image from lacking. If the image formation speed in the monochromic mode is designed equal to that in the multi-color mode, the toner image in the monochromic mode has a thickness thinner than that of the toner image in the multi-color mode. Therefore, the amount of heat imparted to the thinner toner image can be decreased and accordingly, in this case, the monochromic target temperature $T_5$ in the monochromic mode can be set lower than the target temperature $T_0$ in the multi-color mode.

FIG. 3 illustrates an example of the monochromic target temperature $T_5$, which is set higher than the target temperature $T_0$. On activation after the power-on, activation after the preheat mode, or even during the activation, the first temperature detector 18 may detect that the temperature on the fixing belt 12 is lower than the first reference temperature $T_1$. At this moment, for example, at the point of time $t_8$ or $t_9$, if a monochromic print command for forming a monochromic toner image on the recording medium P is input, a maximum allowable power is supplied to the first heater 16. This operation is performed continuously until the first temperature detector 18 detects that the temperature on the fixing belt 12 reaches the monochromic target temperature $T_5$ as shown with dotted line XA or XB in FIG. 3. Fixation can be allowed to start at the time $t_{10}$ or $t_{11}$ when the first temperature detector 18 detects that the temperature on the fixing belt 12 reaches the monochromic target temperature $T_5$. In this case, the second heater 17 is not employed to heat the counter roller 13. The counter roller 13, the supporting roller 14, the heating roller 15, and the fixing belt 12 are not driven to rotate. In addition, the maximum power is continuously supplied to the first heater 16 to heat the fixing belt 12 up to the monochromic target temperature $T_5$ in a short time to complete the activation. This is effective to further reduce the warm-up time for the fixing device.

Other counter members than the counter roller 13 shown in FIG. 2 may be employed. For example, a non-rotator counter member that press-contacts the fixing belt can be employed. In the shown example, however, the counter member consists of the counter roller 13 that press-contacts the fixing belt 12 and rotates. The counter roller 13 is driven to rotate when the temperature on the fixing belt 12 detected by the first temperature detector 18 reaches the first reference temperature $T_1$. This configuration allows the whole counter member to be heated up uniformly to a certain temperature (the second reference temperature $T_2$) in a short time.

Figure 4:
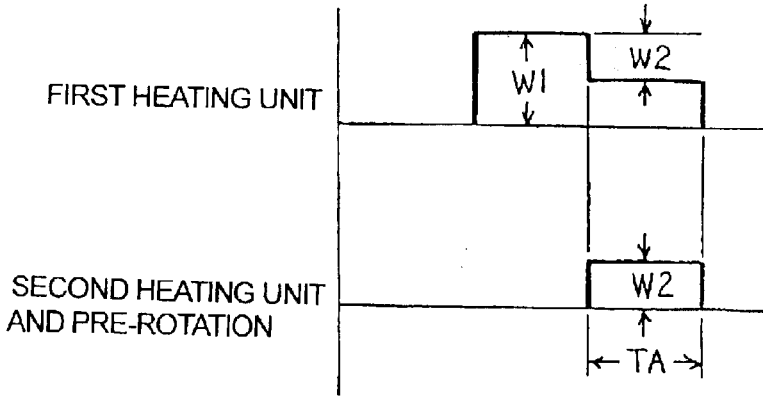
FIG. 4 illustrates another example of control of the fixing device different.

The fixing device shown in FIGS. 1 and 2 may be controlled during activation thereof in such a mode shown in FIG. 4 that is slightly different from the mode shown in FIG. 3.

In this case, the power to the image forming apparatus is turned on to start activation of the fixing device 2. During the activation, if the temperature on the fixing belt 12 is lower than a preset certain temperature A1, a first power W1 is supplied to the first heater 16 for heating the fixing belt as shown in FIG. 4. The first power W1 is the maximum power applicable to the fixing device 2. The heating elevates the temperatures on the heating roller 15 and the portion of the fixing belt wound around the heating roller 15.

When the first temperature detector 18 detects that the surface temperature on the portion of the fixing belt wound around the heating roller 15 reaches the preset certain temperature A1, at least the fixing belt 12 of elements in the fixing device 2 is driven rotationally. Thus, the fixing device starts pre-rotation. Normally, the supporting roller 14, the heating roller 15, and the counter roller 13 shown in FIG. 2 rotate in the respective directions of the arrows to drive the fixing belt 12 rotationally in the direction of the arrow F. In addition, as shown in FIG. 4, power is supplied to the second heater 17 for heating the counter roller 13.

The first temperature detector 18A shown in FIG. 2 with the chain line may also be employed. In this case, when the first temperature detector 18A detects that the temperature on the heating roller 15 reaches the preset certain temperature A1, the surface temperature on the fixing belt 12 is regarded as reached the preset certain temperature A1. Also in this case, the fixing device 2 starts pre-rotation, and power is supplied to the second heater 17.

The certain temperature A1 may be a temperature (the target temperature $T_0$ in FIG. 3) on the fixing belt 12 suitable for fixing the toner image TM on the recording medium P. Alternatively, it may be a temperature higher or lower than the target temperature $T_0$.

The maximum power applicable to the fixing device 2 is the first power W1. The sum of the power supplied to the second heater 17 after the temperature on the fixing belt 12 reaches the certain temperature A1 and the power required for pre-rotation of the fixing device 2 is defined as a second power W2. In this case, the power supplied to the first heater 16 after the temperature on the fixing belt 12 reaches the certain temperature A1 is changed to W1–W2. When a certain time TA elapses after the pre-rotation and the supply of power to the second heater 17 starts, the activation of the fixing device 2 is finished, and the operation of fixing the toner image on the recording medium is allowed as described above.

As described above, the fixing device 2 includes the endless fixing belt 12 wound around between a plurality of belt supports including the driving roller and heated by the first heater 16, the counter member disposed opposite to one of the belt supports via the fixing belt 12 and heated by the second heater 17, and the temperature detector 18 or 18A which detects the surface temperature on the fixing belt 12 directly or indirectly. If the surface temperature on the fixing belt 12 is lower than the certain temperature A1 during activation, the first power W1 is supplied to the first heater 16. If the surface temperature on the fixing belt 12 reaches the certain temperature A1, the second power W2 is supplied to heat the second heater 17. At the same time, at least the fixing belt 12 is driven rotationally, and the power supplied to the first heater 16 is dropped to an amount equal to the amount obtained by subtracting the second power W2 from the first power W1.

This configuration is also effective to reduce the warm-up time for the fixing device. This is because after activation of the fixing device starts, the maximum first power W1 is supplied to the first heater 16 to heat the fixing belt, which has a small thermal capacity and is accordingly heated up to a high temperature soon.

In the above embodiment, the time of pre-rotation for driving the fixing belt 12 rotationally is determined as the preset time TA to simplify the control mode. Alternatively, the time of pre-rotation for driving the fixing belt 12 rotationally may be determined based on the surface temperature on the fixing belt 12 detected during activation. Specifically, when the power to the image forming apparatus is turned on, the temperature detector 18 or 18A is employed to detect the surface temperature on the fixing belt 12. If the temperature is high, the time of pre-rotation is determined shorter than that for a lower temperature.

According to such the configuration, when an ambient temperature is high, the temperature on the fixing device is also high when the power to the image forming apparatus is turned on. Therefore, the shorter time of pre-rotation causes no problem. This is effective to further reduce the warm-up time for the fixing device 2.

The time of pre-rotation for driving the fixing belt 12 rotationally may be determined based on the surface temperature on the counter member detected during activation. Specifically, when the power to the image forming apparatus is turned on, the temperature detector 19 is employed to detect the surface temperature on the counter roller 13. If the temperature is high, the time of pre-rotation is determined shorter than that for a lower temperature.

According to such the configuration, the counter roller 13 has a larger thermal capacity than that of the fixing belt 12. Therefore, if the surface temperature on the counter roller 13 is detected, the time during which the fixing device 2 sits idle (a non-operation time after completion of the previous job: "idle time") can be detected more accurately than the case where the surface temperature on the fixing belt 12 is detected. In addition, based on the idle time of the fixing device 2, the pre-rotation time for the fixing device 2 can be determined. If the idle time is short, the counter roller 13 has a higher temperature than that when the idle time is longer.

Thus, the pre-rotation time can be shortened. This is effective to prevent the pre-rotation time from extending unnecessarily and inhibit the warm-up time for the fixing device from extending uselessly.

The fixing device 2 includes the fixing belt 12 wound around between at least two belt supports, the counter member disposed opposite to one of the belt supports via the fixing belt 12, the first heater 16 which heats the fixing belt 12, the second heater 17 which heats the counter member, and the temperature detector 18 or 18A which detects the temperature on the fixing belt 12. The fixing belt 12 and the counter member define a nip therebetween, through which the recording medium P is passed to fix the image on the recording medium P. The fixing device 2 further includes the power controller, not shown, which varies the ratio of the power supplied to the second heater 17 to that to the first heater 16 based on the temperature detected by the temperature detector 18 or 18A.

In the example shown in FIG. 3, after the power to the image forming apparatus is turned on and before the temperature on the fixing belt 12 reaches the first reference temperature T1, power is supplied only to the first heater 16. When the temperature detector 18 or 18A detects that the temperature on the fixing belt 12 reaches the first reference temperature $T_1$, power is also supplied to the second heater 17 in addition to the first heater 16. In this way, the ratio of the power supplied to the second heater 17 to the power to the first heater 16 is changed depending on the time before and after the temperature on the fixing belt 12 reaches the first reference temperature $T_1$. This is similarly applied to the embodiment shown in FIG. 4. In this case, the ratio between the powers supplied to the first 16 and the second 17 heaters is changed depending on the time before and after the temperature detector 18 or 18A detects that the surface temperature on the fixing belt 12 reaches the certain temperature A1.

Such the configuration allows the warm-up time for the fixing device during activation to be reduced.

In the embodiment shown in FIG. 3, the power is not supplied to the second heater 17 when the temperature on the fixing belt 12 is lower than the first reference temperature $T_1$. Alternatively, a lower power than that supplied to the first heater may be supplied to the second heater 17. Then, when the temperature on the fixing belt 12 reaches the first reference temperature $T_1$, the powers supplied to the heaters 16 and 17 are controlled so as to increase the power supplied to the second heater 17 higher than the previously supplied amount to reduce the warm-up time. This is similarly effected in the embodiment in FIG. 4.

In the embodiments, the ratio between the powers supplied to the first and the second heaters 16 and 17 is varied based on the temperature detected by the temperature detector 18 or 18A. If a time of supplying power to at least one of the first and the second heaters 16 and 17 can be detected, the ratio between the powers supplied to the first and the second heaters 16 and 17 may be varied based on the detected result.

More specifically, in the example shown in FIG. 3, when the first temperature detector 18 detects that the temperature on the fixing belt 12 reaches the first reference temperature $T_1$, power is supplied to the second heater 17 in addition to the first heater 16. Instead of this configuration, a time detector, not shown, may be employed to detect that the certain time $t_1$ elapses after the point of time to when the power to the image forming apparatus is turned on. If the elapse is detected, the control is switched from the power supply only to the first heater 16 to the power supply to the first and the second heaters 16 and 17.

Also in the example shown in FIG. 4, it is controlled that the powers are supplied to both the first and the second heaters 16 and 17, not from the point of time when the temperature on the fixing belt 12 is detected to reach the certain temperature A1, but from the point of time when the time detector detects that the certain time elapses after the power-on of the image forming apparatus.

Also in this case, at the point of time before the temperature on the fixing belt 12 reaches the certain temperature $T_1$ or A1, a lower power than that supplied to the first heater 16 may be supplied to the second heater 17.

As described above, the fixing device 2 includes the fixing belt 12 wound around between at least two belt supports, the counter member disposed opposite to one of the belt supports via the fixing belt 12, the first heater 16 which heats the fixing belt 12, and the second heater 17 which heats the counter member. The fixing belt 12 and the counter member define a nip therebetween, through which the recording medium P is passed to fix an image on the recording medium P. The fixing device 2 further includes the time detector which detects a time of supplying power to at least one of the first 16 and the second 17 heaters, and a power controller, not shown, which varies the ratio of the power supplied to the second heater 17 to that to the first heater 16 based on the time detected by the time detector.

As obvious from the foregoing, when the configuration for varying the ratio between the powers supplied to the first and the second heaters 16 and 17 is applied, the power controller can vary the ratio during activation of the fixing device 2. The power controller may increase the ratio of the power supplied to the second heater 17 to that to the first heater 16 when the detected temperature exceeds a certain temperature or the detected time exceeds a certain time. Such a configuration is effective to reduce the warm-up time for activation of the fixing device 2. The fixing belt 12 may be driven rotationally when the detected temperature exceeds a certain temperature or the detected time exceeds a certain time during activation. This is effective to uniformly heat the whole fixing belt 12.

The configuration for varying the amounts of power supplied to the first and the second heaters 16 and 17 can be applied not only to the activation of the fixing device 2 but also to other cases such as the fixation. This is effective to prevent a fixation defect from occurring in the toner image, for example. More specifically, when plural recording media are successively sent to the nip between the fixing belt 12 and the counter roller 13, the recording media take a large amount of heat from the fixing belt 12. As a result, the temperature on the fixing belt 12 is possibly lowered sharply to a temperature lower than that suitable for fixing the toner image. In this case, the ratio of the power supplied to the first heater 16 is increased higher than the previous value. This is effective to prevent the temperature on the fixing belt 12 from extremely falling to cause a fixation defect in the toner image.

In the fixing device 2 shown in FIG. 2, the fixing belt 12 is wound around between the two rollers or the supporting roller 14 and the heating roller 15. The first heater 16 is provided only in the heating roller 15. During activation of the fixing device 2, the first heater 16 is employed first to heat the portion of the fixing belt other than the nip between the fixing belt 12 and the counter roller 13 to thereby heat the fixing belt 12 that has a small thermal capacity, in a short time. Alternatively, the fixing belt 12 may be wound around among three or more rollers, and the first heater 16 may be provided in each of these rollers. In a word, the fixing belt may be formed of an endless belt wound around between at least two rollers and driven rotationally, and the first heater is disposed inside at least one of the rollers for supporting the fixing belt. The first heater may also be configured to heat the fixing belt 12 from the exterior thereof.

The second heater can be employed to heat the counter member from the exterior thereof. If the counter member includes a counter roller that press-contacts the fixing belt rotationally, and the second heater is disposed inside the counter roller, the counter member can be heated also from the interior thereof. This is effective to heat the counter member up to a certain temperature in a much shorter time.

If one of the belt supports for supporting the fixing belt 12 may be configured as a driving roller, the other belt supports may be configured as stationary members that cannot rotate and allow the fixing belt to slide along the curved surface of the members.

The power supplied to the first heater can be adjusted by varying a ratio of a time to flow current into the first heater to a time to flow no current. Specifically, when a maximum allowable power is supplied to the first heater, the current flow into the heater is continuously carried out. To the contrary, when the power supplied to the first heater is dropped, the current flow into the heater is switched on/off repeatedly at a certain interval.

An induction heating coil may be employed as the heater that is provided in the interior or exterior of the heating roller 15 and the counter roller 13. When current is flowed into the coil to heat the rollers 15 and 13, the fixing belt 12 is warmed up.

Although FIG. 1 illustrates an example of the color image forming apparatus provided with the fixing device 2, the present invention is also applicable to the image forming apparatus mainly dedicated for monochromic images and to the fixing device thereof.

According to the present invention, the warm-up time for the fixing device can be effectively reduced.

Particularly, according to the eighth to the twelfth aspect of the invention, the problem caused by powers always supplied at a constant ratio to the first and the second heaters can be solved.

The present document incorporates by reference the entire contents of Japanese priority documents, 2002-180568 filed in Japan on Jun. 20, 2002, 2002-275689 filed in Japan on Sep. 20, 2002 and 2003-125899 filed in Japan on Apr. 30, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing device comprising:

a fixing belt which is driven rotationally;

a counter member disposed opposite to the fixing belt;

a first heater which heats the fixing belt; and a second heater which heats the counter member, wherein the fixing belt and the counter member define a nip therebetween, through which a recording medium carrying a toner image to be fixed thereon is passed such that the toner image is directed to contact a surface of the fixing belt, in the presence of heat and pressure applied to toner in the toner image during passage thereof to fix the toner image on the recording medium, wherein a target temperature on the fixing belt during fixation is previously set, and first and second reference temperatures are previously set, the first and second reference temperatures being lower than the target temperature, a maximum allowable power is supplied to the first heater to heat the fixing belt when the temperature on the fixing belt is lower than the first reference temperature during activation of the fixing device, the fixing belt is driven rotationally, power supplied to the first heater is decreased, and power is also supplied to the second heater when the temperature on the fixing belt reaches the first reference temperature, and fixation is allowed to start at a point in time at which the temperature on the fixing belt reaches the target temperature and the temperature on the counter member reaches the second reference temperature.

2. The fixing device according to claim 1, wherein the target temperature is a temperature required for fixing a composite toner image formed by superimposing toner images of at least two colors on the recording medium, and the target temperature on the fixing belt required for fixing a monochromic toner image carried on the fixing belt is defined as a monochrome target temperature, wherein when a print command for forming a monochromic toner image on the recording medium is input during activation of the fixing device in which the temperature on the fixing belt is lower than the first reference temperature, a maximum allowable power is continuously supplied to the first heater until the temperature on the fixing belt reaches the monochrome target temperature to allow fixation to start at a point in time at which the temperature on the fixing belt reaches the monochrome target temperature.

3. The fixing device according to claim 1, wherein the counter member comprises a counter roller which press-contacts the fixing belt and rotates, the counter roller being driven rotationally when the temperature on the fixing belt reaches the first reference temperature during activation of the fixing device.

4. The fixing device according to claim 1, wherein the fixing belt is an endless belt wound around between at least the two rollers and driven rotationally.

5. The fixing device according to claim 4, wherein the first heater is disposed inside one of the rollers.

6. The fixing device according to claim 1, wherein the counter member is a counter roller which press-contacts the fixing belt to rotate, and the second heater is disposed inside the counter roller.

7. A fixing device comprising:

a driving roller;

a plurality of belt supports including the driving roller;

a first heater;

an endless fixing belt wound around between the belt supports and heated by the first heater;

a second heater;

a counter member disposed opposite to one of the belt supports via the fixing belt and heated by the second heater; and a temperature detector which detects a surface temperature on the fixing belt, wherein when the surface temperature on the fixing belt is lower than a predetermined temperature during activation of the device, a first power is supplied to the first heater, and when the surface temperature on the fixing belt reaches the predetermined temperature, a second power is supplied to heat the second heater, at least the fixing belt is driven rotationally, and the power supplied to the first heater is dropped to an amount equal to an amount obtained by subtracting the second power from the first power.

8. The fixing device according to claim 7, wherein a time for driving the fixing belt rotationally is a predetermined time.

9. The fixing device according to claim 7, wherein a time for driving the fixing belt rotationally is set based on the surface temperature on the fixing belt detected during activation.

10. The fixing device according to claim 7, wherein a time for driving the fixing belt rotationally is set based on the surface temperature on the counter member detected during activation of the fixing device.

11. The fixing device according to claim 7, wherein the fixing belt is an endless belt wound around between at least the two rollers and driven rotationally.

12. The fixing device according to claim 11, wherein the first heater is disposed inside one of the rollers.

13. The fixing device according to claim 7, wherein the counter member is a counter roller which press-contacts the fixing belt to rotate, and the second heater is disposed inside the counter roller.

14. A fixing device comprising:

at least two belt supports;

a fixing belt wound around between at least the two belt supports;

a counter member disposed opposite to one of the belt supports via the fixing belt;

a first heater which heats the fixing belt;

a second heater which heats the counter member;

a temperature detector which detects a temperature on the fixing belt, wherein the fixing belt and the counter member define a nip therebetween, through which a recording medium is passed to fix an image on the recording medium; and a power controller which varies a ratio of power supplied to the second heater to power to the first heater based on the temperature detected by the temperature detector.

15. The fixing device according to claim 14, wherein the power controller varies the ratio during activation of the fixing device.

16. The fixing device according to claim 14, wherein the power controller increases the ratio of the power supplied to the second heater to the power to the first heater in either of a case where the detected temperature exceeds a predetermined temperature and a case where the detected time exceeds a predetermined time.

17. The fixing device according to claim 14, wherein the fixing belt is driven rotationally in either of a case where the detected temperature exceeds a predetermined temperature and a case where the detected time exceeds a predetermined time during activation of the fixing device.

18. The fixing device according to claim 14, wherein the fixing belt is an endless belt wound around between at least the two rollers and driven rotationally.

19. The fixing device according to claim 18, wherein the first heater is disposed inside one of the rollers.

20. The fixing device according to claim 14, wherein the counter member is a counter roller which press-contacts the fixing belt to rotate, and the second heater is disposed inside the counter roller.

21. A fixing device comprising:

at least two belt supports;

a fixing belt wound around between at least the two belt supports;

a counter member disposed opposite to one of the belt supports via the fixing belt;

a first heater which heats the fixing belt;

a second heater which heats the counter member, wherein the fixing belt and the counter member define a nip therebetween, through which a recording medium is passed to fix an image on the recording medium;

a time detector which detects a time of supplying power to at least one of the first and the second heaters; and a power controller which varies a ratio of power supplied to the second heater to power to the first heater based on the time detected by the time detector.

22. The fixing device according to claim 21, wherein the power controller varies the ratio during activation of the fixing device.

23. The fixing device according to claim 21, wherein the power controller increases the ratio of the power supplied to the second heater to the power to the first heater in either of a case where the detected temperature exceeds a predetermined temperature and a case where the detected time exceeds a predetermined time.

24. The fixing device according to claim 21, wherein the fixing belt is driven rotationally in either of a case where the detected temperature exceeds a predetermined temperature and a case where the detected time exceeds a predetermined time during activation of the fixing device.

25. The fixing device according to claim 21, wherein the fixing belt is an endless belt wound around between at least the two rollers and driven rotationally.

26. The fixing device according to claim 25, wherein the first heater is disposed inside one of the rollers.

27. The fixing device according to claim 21, wherein the counter member is a counter roller which press-contacts the fixing belt to rotate, and the second heater is disposed inside the counter roller.

28. An image forming apparatus comprising:

a fixing device including a fixing belt which is driven rotationally;

a counter member disposed opposite to the fixing belt;

a first heater which heats the fixing belt; and a second heater which heats the counter member, wherein the fixing belt and the counter member define a nip therebetween, through which a recording medium carrying a toner image to be fixed thereon is passed such that the toner image is directed to contact a surface of the fixing belt, in the presence of heat and pressure applied to toner in the toner image during passage thereof to fix the toner image on the recording medium, wherein a target temperature on the fixing belt during fixation and first and second reference temperatures are previously set, first and second reference temperatures being lower than the target temperature, a maximum allowable power is supplied to the first heater to heat the fixing belt when the temperature on the fixing belt is lower than the first reference temperature during activation of the fixing device, the fixing belt is driven rotationally, power supplied to the first heater is decreased, and power is also supplied to the second heater when the temperature on the fixing belt reaches the first reference temperature, and fixation is allowed to start at a point in time at which the temperature on the fixing belt reaches the target temperature and the temperature on the counter member reaches the second reference temperature.

29. An image forming apparatus comprising:

a fixing device including a driving roller;

a plurality of belt supports including the driving roller;

a first heater;

an endless fixing belt wound around between the belt supports and heated by the first heater;

a second heater;

a counter member disposed opposite to one of the belt supports via the fixing belt and heated by the second heater; and a temperature detector which detects a surface temperature on the fixing belt, wherein when the surface temperature on the fixing belt is lower than a predetermined temperature during activation of the device, a first power is supplied to the first heater, and when the surface temperature on the fixing belt reaches the predetermined temperature, a second power is supplied to heat the second heater, at least the fixing belt is driven rotationally, and the power supplied to the first heater is dropped to an amount equal to an amount obtained by subtracting the second power from the first power.

30. An image forming apparatus comprising:

a fixing device including at least two belt supports;

a fixing belt wound around between at least the two belt supports;

a counter member disposed opposite to one of the belt supports via the fixing belt;

a first heater which heats the fixing belt;

a second heater which heats the counter member;

a temperature detector which detects a temperature on the fixing belt, wherein the fixing belt and the counter member define a nip therebetween, through which a recording medium is passed to fix an image on the recording medium; and a power controller which varies a ratio of power supplied to the second heater to power to the first heater based on the temperature detected by the temperature detector.

31. An image forming apparatus comprising:

a fixing device including at least two belt supports;

a fixing belt wound around between at least the two belt supports;

a counter member disposed opposite to one of the belt supports via the fixing belt;

a first heater which heats the fixing belt;

a second heater which heats the counter member, wherein the fixing belt and the counter member define a nip therebetween, through which a recording medium is passed to fix an image on the recording medium;

a time detector which detects a time of supplying power to at least one of the first and the second heaters; and a power controller which varies a ratio of power supplied to the second heater to power to the first heater based on the time detected by the time detector.

* * * * *